US006546878B1

(12) United States Patent
Smith et al.

(10) Patent No.: US 6,546,878 B1
(45) Date of Patent: Apr. 15, 2003

(54) MULTI-UNIT RAILROAD FREIGHT CAR FOR CARRYING CARGO CONTAINERS

(75) Inventors: David W. Smith, Moscow, ID (US); Gregory J. Saxton, Portland, OR (US)

(73) Assignee: Gunderson, Inc., Portland, OR (US)

( * ) Notice: Subject to any disclaimer, the term of this patent is extended or adjusted under 35 U.S.C. 154(b) by 0 days.

(21) Appl. No.: 09/976,690

(22) Filed: Oct. 12, 2001

(51) Int. Cl.[7] ..... B61D 17/00

(52) U.S. Cl. ..... 105/404; 105/3; 105/355; 105/458

(58) Field of Search ..... 105/404, 3, 4.1, 105/355, 396, 159, 458

(56) References Cited

U.S. PATENT DOCUMENTS

| | | | | | |
|---|---|---|---|---|---|
| 1,110,394 | A | | 9/1914 | Lindall | 105/3 |
| 1,114,552 | A | | 10/1914 | Taurman | 105/3 |
| 1,168,335 | A | | 1/1916 | Rowntree | 105/3 |
| 1,617,658 | A | | 2/1927 | Suarez | 105/4.1 |
| 1,634,490 | A | | 7/1927 | Collis | 105/1.4 |
| 3,290,058 | A | * | 12/1966 | Ellerd | 105/3 |
| 4,150,628 | A | | 4/1979 | Keldenich | 105/367 |
| 4,191,107 | A | * | 3/1980 | Ferris et al. | 105/4.1 |
| 4,428,296 | A | | 1/1984 | Scheuchzer et al. | 104/2 |
| 4,597,337 | A | * | 7/1986 | Willetts | 105/4.1 |
| 4,671,714 | A | * | 6/1987 | Bennett | 105/3 |
| 4,703,699 | A | | 11/1987 | Hill | 105/355 |
| 4,741,273 | A | * | 5/1988 | Sherwood | 105/4.1 |
| 4,798,148 | A | | 1/1989 | Girard | 105/17 |
| 4,864,938 | A | * | 9/1989 | Hesch et al. | 105/4.1 |
| 4,893,567 | A | | 1/1990 | Hill et al. | 105/419 |
| 4,929,132 | A | * | 5/1990 | Yeates et al. | 410/45 |
| 4,947,760 | A | * | 8/1990 | Dawson et al. | 105/3 |
| 4,949,646 | A | * | 8/1990 | Jamrozy et al. | 105/406.1 |
| 4,951,575 | A | | 8/1990 | Dominguez et al. | 105/406 |
| 4,955,144 | A | | 9/1990 | Lienard et al. | 105/4.2 |
| 5,090,331 | A | * | 2/1992 | Hesch et al. | 105/3 |
| 5,170,718 | A | * | 12/1992 | Hill et al. | 105/4.1 |
| 5,197,392 | A | | 3/1993 | Jeunehomme | 105/3 |
| 5,207,161 | A | * | 5/1993 | Pileggi et al. | 105/4.1 |
| 5,279,230 | A | | 1/1994 | Thomas et al. | 105/355 |
| 5,372,073 | A | | 12/1994 | Cattani | 105/3 |
| 5,423,269 | A | | 6/1995 | Saxton et al. | 105/355 |
| 5,511,491 | A | | 4/1996 | Hesch et al. | 105/404 |
| 5,626,083 | A | | 5/1997 | Saxton | 105/355 |
| 5,657,698 | A | * | 8/1997 | Black, Jr. et al. | 105/3 |
| 6,095,055 | A | | 8/2000 | Lohr et al. | 105/42 |
| 6,199,486 | B1 | | 3/2001 | Landrum et al. | 105/396 |

OTHER PUBLICATIONS

Car and Locomotive Cyclopedia , 1997 , p. 207: TTEX "Long Runner" car.

U.S. patent application Ser. No. 09/976,655, Zaerr et al., filed Oct. 12, 2001.

* cited by examiner

*Primary Examiner*—S. Joseph Morano
*Assistant Examiner*—Lars A. Olson
(74) *Attorney, Agent, or Firm*—Chernoff, Vilhauer, McClung & Stenzel, LLP

(57) ABSTRACT

A multi-unit railroad freight car and a container-carrying bridge unit for such a car. The bridge unit extends between and is carried on the adjacent body bolsters of both of a pair of drawbar-connected well units designed for carrying stacked cargo containers. The bridge unit includes a center sill, a transverse bolster at each end of the center sill, and container-supporting arms extending from the bolsters and above the body bolsters of the adjacent container well units to support a cargo container.

22 Claims, 5 Drawing Sheets

MULTI-UNIT RAILROAD FREIGHT CAR FOR CARRYING CARGO CONTAINERS

BACKGROUND OF THE INVENTION

The present invention relates to multi-unit railroad freight cars, and in particular to such a car including container well units.

Within the limits of available space along railroad tracks and the ability of the tracks to support loaded freight cars safely, it is economically desirable to carry as heavy a load of revenue-earning cargo as possible in a given train length. Increased cargo weight for a given train length gives increased cost efficiency, since the train crew wages, train mile and fuel expenses, and locomotive costs are shared by the increased amount of cargo revenue.

Freight cars including multiple well units for carrying stacked intermodal cargo containers are well known. Some of these cars use shared trucks to support adjacent well units. Others use drawbars to interconnect adjacent units that are each fully supported by their own trucks. In both of these types of multi-unit container well cars the large space between the ends of containers carried in adjacent well units results in a significant amount of aerodynamic drag during train operation and leaves a significant portion of the length of a train in which no cargo containers are present.

Within the railroad industry there are regulations in effect limiting the maximum weight of a loaded intermodal cargo container, and railroad cars are designed with ample strength to carry various combinations of such cargo containers safely. For example, containers of nominal 20-foot length are limited to 52,900 pounds, nominal 40-foot containers are limited to 67,200 pounds and nominal 53-foot containers may be designed for either 56,700 pounds or 67,200 pounds. These maximum weights must be considered when loading a railroad car, in order not to overstress the car body or overload its trucks and thus concentrate too much weight on the tracks. As a result, a well unit carrying two fully loaded 20-foot containers may not be able to carry a fully loaded 40-foot or longer container safely in an upper tier.

While cargo capacity of such cars could be increased by building stronger container well bodies and using trucks of greater capacity, such bodies are so large and heavy that they have not been desired.

Utilization of shared trucks to support adjacent well units for carrying stacked containers in such multi-unit railroad freight cars can reduce the portion of the length of car in which there are no containers, but it also requires restricting the weight or number of containers which can be carried stacked in each of those adjacent well units carried by a single shared truck, in order to avoid overloading the shared truck. This often results in the unshared truck at each end of such a multi-unit well car being significantly under-loaded. As a result, such multi-unit well cars with shared trucks are often loaded to less than the optimum ratio of load weight to the length of a train of such cars.

What is desired, then, is a container-carrying multi-unit railroad freight car that has improved aerodynamic characteristics when loaded, that can be loaded to utilize more fully the available carrying capacity of the trucks with which such a multi-unit car is equipped, and in which the cargo weight for such a multi-unit car of a given length and container well size is maximized.

SUMMARY OF THE INVENTION

The present invention overcomes some of the aforementioned drawbacks and provides an answer to some of the shortcomings of the prior art railroad cars mentioned above by providing a multi-unit railroad freight car for carrying containers, in which at least two coupled container well units each include a container well and have respective body end structures, and in which a container-supporting bridge unit is located between the two container well units and has a pair of opposite ends each supported on the body of a respective one of the two adjacent container well units.

In one preferred embodiment of such a freight car a container support structure included in the bridge unit extends above the body bolster structure of the end of the adjacent container well unit.

In one embodiment of the invention the multi-unit freight car has a container-supporting bridge unit that includes an elongate center sill including opposite sill ends and has a center bearing associated with each of the opposite sill ends.

One aspect of the invention is the provision of a multi-unit railroad freight car that includes a bridge unit having a pair of transverse bolsters each attached to a center sill, and in which at least one of the transverse bolsters has a side bearing support leg aligned with a corresponding side bearing located on the body of an adjacent container well unit.

As one aspect of the invention a container-supporting bridge unit for a multi-unit railroad freight car includes a pair of opposite ends and a pair of container support arms associated with each of its opposite ends, and each of the opposite ends is supported by body end structure, such as a body bolster, of the adjacent container well unit of a multi-unit car including such a bridge unit.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
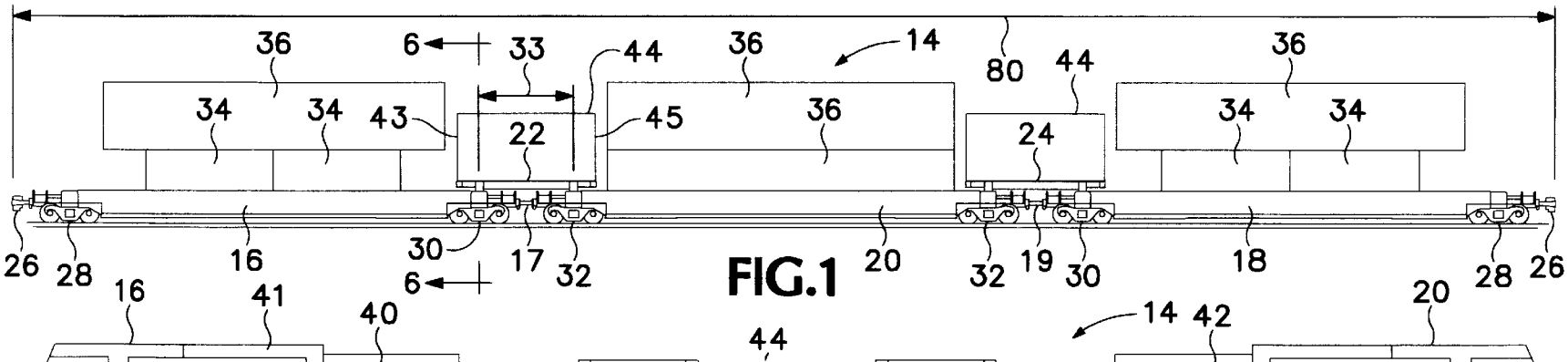
FIG. 1 is a side elevational view of a multi-unit railroad freight car which includes one preferred embodiment of the invention.

Referring now to the drawings which form a part of the disclosure herein, a multi-unit railroad freight car 14 embodying the present invention is shown in FIG. 1. The freight car 14 includes five car units, of which a first container well unit 16 is at one end, a second container well unit 18 is at the opposite end, and a third container well unit 20 is in the middle of the 5-unit car. The container well units 16, 18 and 20 are coupled with one another by conventional drawbars 17 and 19. Two shorter container-supporting bridge units 22 and 24, similar to each other, are located between the container well units.

There is an ordinary automatic coupler 26 at each end of the 5-unit car 14 for use in coupling the multi-unit car 14 to other cars of a train.

A respective truck 28, for example, a 70-ton truck, is located at each end of the car 14, supporting the outer ends of the two end well units 16 and 18. Larger capacity trucks 30 and 32, for example, 100-ton trucks, support the rest of the multi-unit car.

As in previously-known multi-unit container well cars, the drawbars 17 and 19 coupling the container well units 16, 18 and 20 with each other result in a truck center separation distance 33 of about 13½ feet in the multi-unit car 14.

Figure 2:
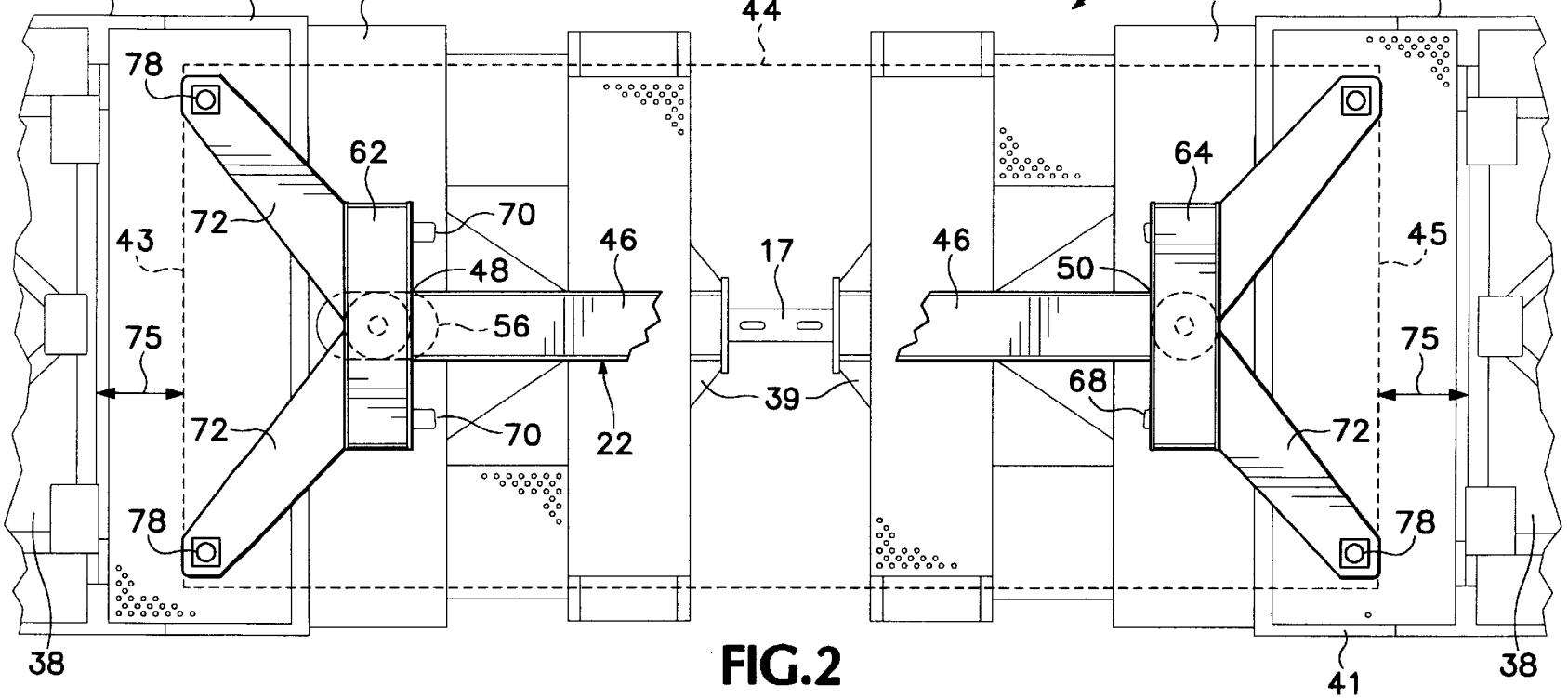
FIG. 2 is a top plan view of a portion of the multi-unit railroad freight car shown in FIG. 1.
Figure 3:
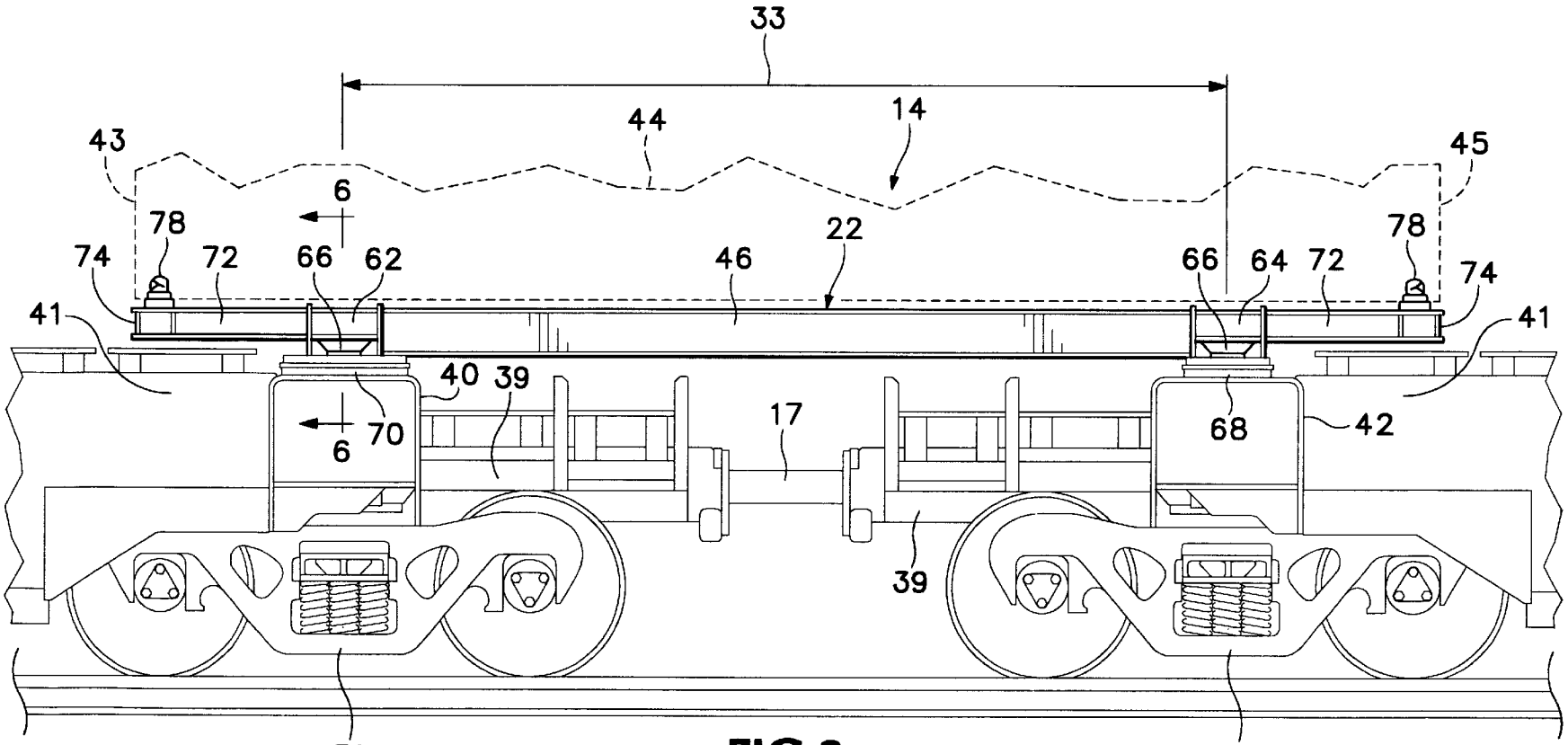
FIG. 3 is a side elevational view of the portion of a multi-unit railroad freight car shown in FIG. 2, including the container-supporting bridge unit together with portions of adjacent container well units and their trucks.
Figure 4:
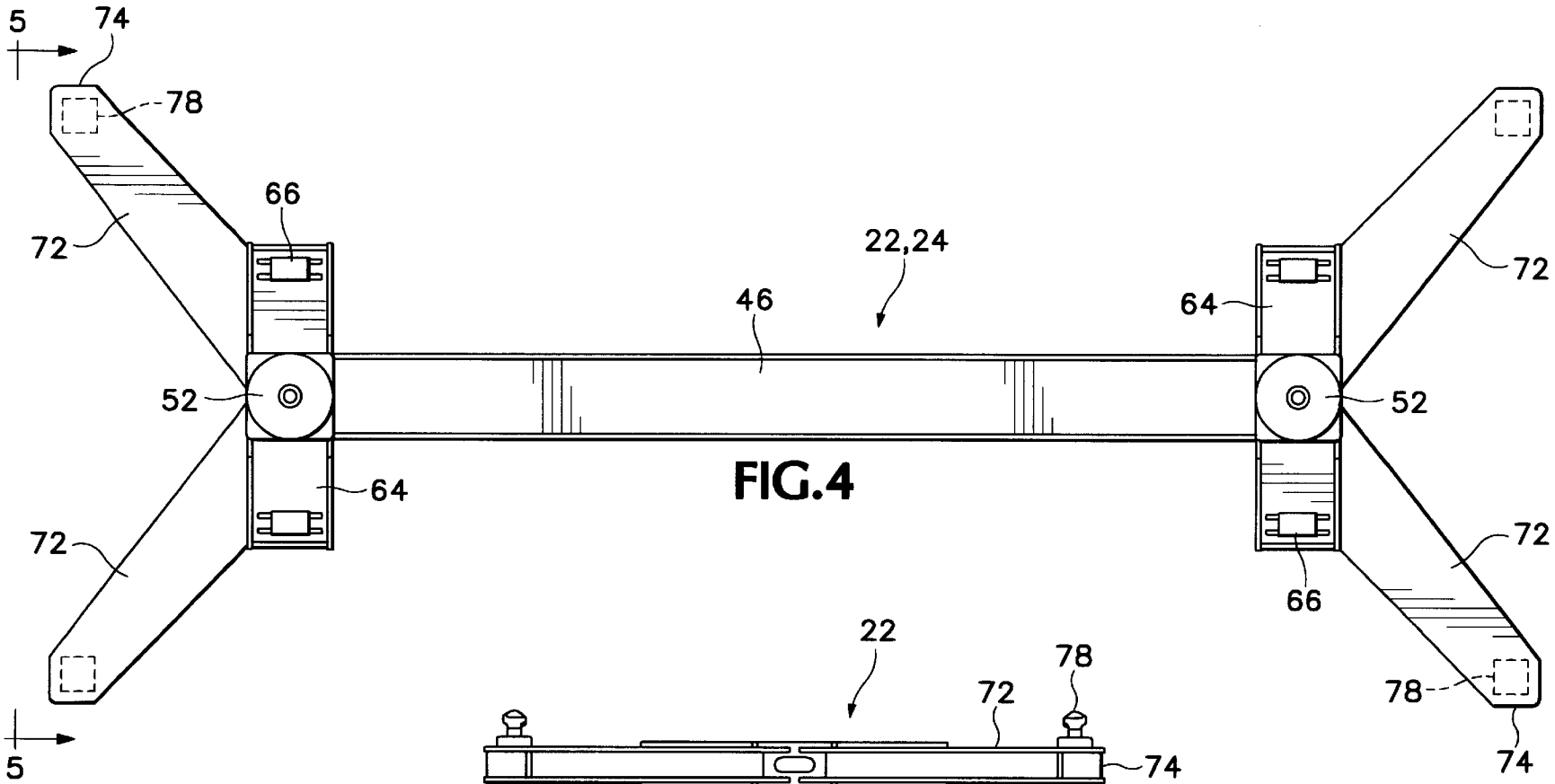
FIG. 4 is a bottom plan view of the container-supporting bridge unit structure shown in FIG. 2.
Figure 5:
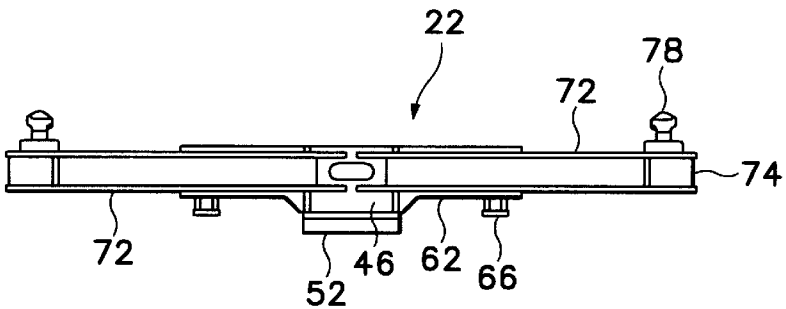
FIG. 5 is an end elevational view of the container-supporting bridge unit shown in FIGS. 3 and 4, in an upright orientation.
Figure 6:
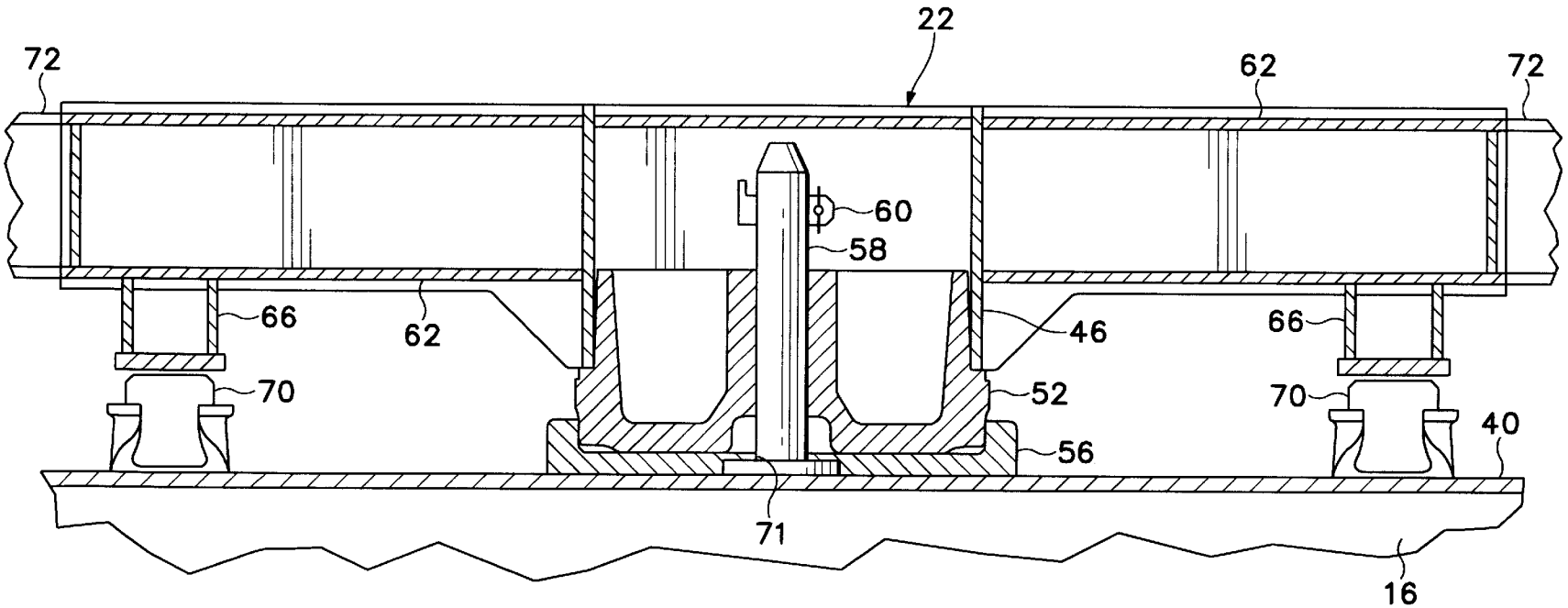
FIG. 6 is a sectional view taken along line 6—6 of FIG. 1.
Figure 7:
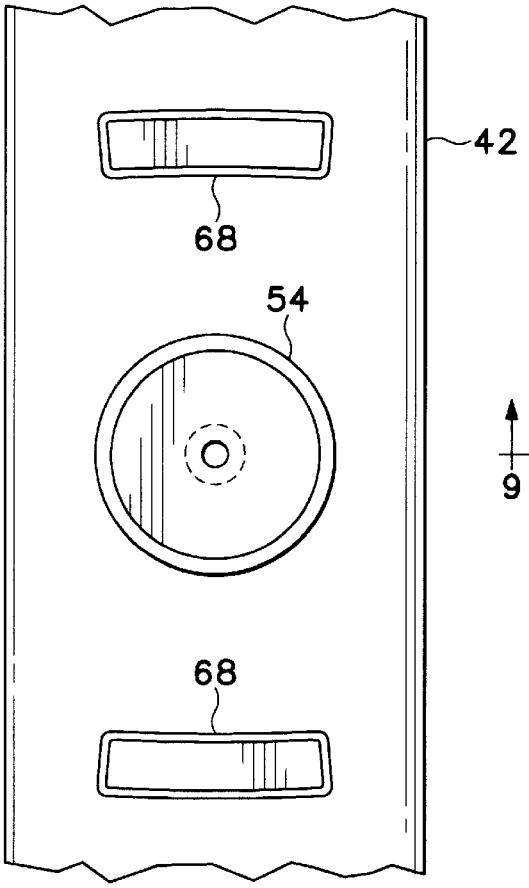
FIG. 7 is a top plan detail view of a portion of a body bolster of a well unit supporting one end of a container-supporting bridge unit, including the bowl or lower part of the center bearing and the side bearings supporting the container-supporting bridge unit.
Figure 8:
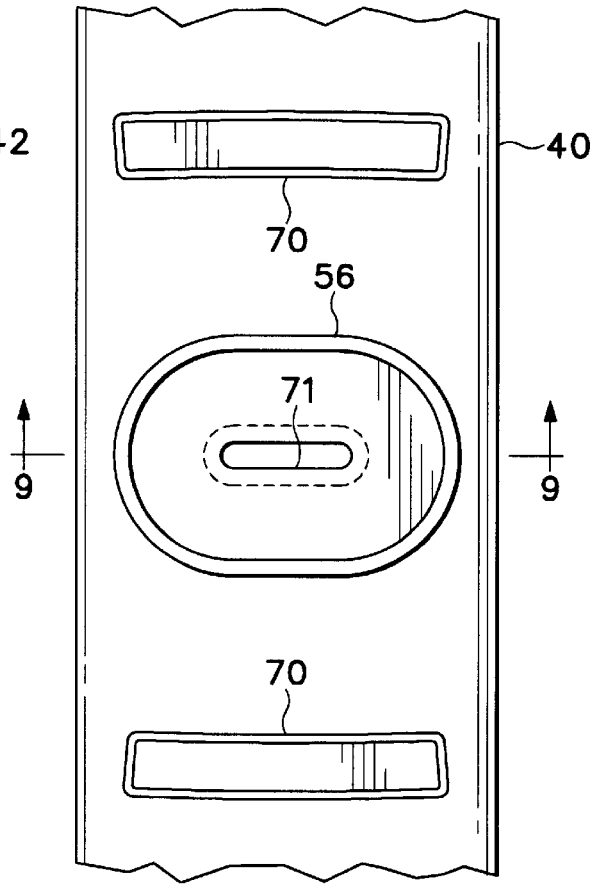
FIG. 8 is a top plan detail view of a portion of a body bolster of a well unit supporting the other end of a container-supporting bridge unit, including the oblong bowl or lower part of the center bearing and the side bearings supporting the container-supporting bridge unit.
Figure 9:
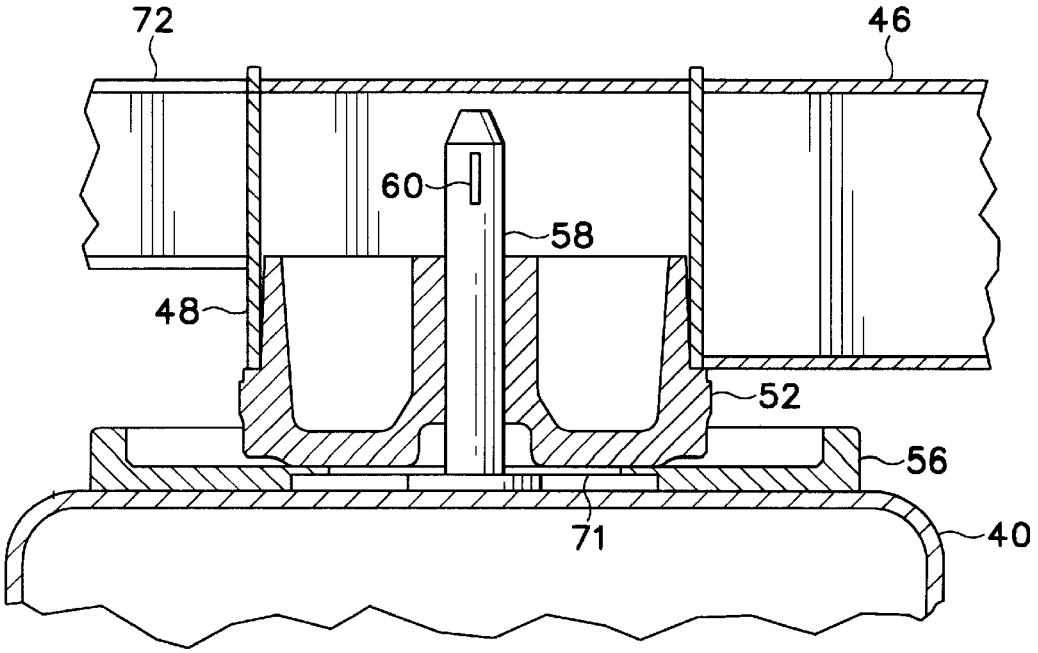
FIG. 9 is a sectional view taken on line 9—9 of FIG. 8.

As shown also in FIGS. 2 and 3, each well unit 16, 18, or 20 may, for example, be generally similar to the well car units disclosed in Hill et al. U.S. Pat. No. 4,893,567, and may be capable of carrying a pair of 20-foot intermodal cargo containers 34, a pair of 24-foot containers (not shown), a single 40-foot container, a 53-foot container 36, or a container of an intermediate length (not shown) in its well 38. A 53-foot container 36 or a shorter container may be stacked as an upper tier on top of the container 36 or containers 34 carried in the well 38.

Each of the container-supporting bridge units 22 and 24 extends between two adjacent ones of the well units 16, 18, and 20, and each end of each bridge unit 22 or 24 is supported by a respective body bolster 40 or 42 of an adjacent one of the container well units 16, 18 and 20. This requires each body bolster 40 and 42 carrying an end of one of the bridge units 22 and 24 to be of suitably reinforced construction, although the details of such structure are not part of the present invention.

The body end structures of the well units 16 and 20 include stub sills 39 extending outward from the body bolsters 40 and 42, and structures 41 extending from the end of each well 38 to the body bolster 40 or 42. The structures 41 may include portions of side sills and well end bulkheads and the like, extending above and around the truck 30 or 32. Appropriate walkways are also present.

Since the well units 16, 18 and 20 support containers 34 and 36 lower than the tops of their body bolsters 40 and 42, each of the bridge units 22 and 24 supports an intermodal cargo container 44 at a location higher than that of each of the containers 34 or 36 held within the well 38 of one of the well units 16, 18 or 20. The container 44 is carried on the bridge unit 22 or 24 so that each end 43 or 45 of the container 44 extends above the respective body bolster 40 or 42 of the adjacent well unit 16, 18 or 20 toward the respective container well 38. The container 44, as shown in the multi-unit car 14, is a nominal 20-foot container, but the bridge units 22 and 24 could be constructed in such a car to carry containers of other lengths instead, if desired, consistent with the lengths of the drawbars 17 and 19.

Each container-supporting bridge unit 22 and 24 includes longitudinal and transverse structural members for supporting cargo loads, but is not intended to carry significant draft or buff loads due to train operation beyond those resulting from its own mass or a container 44 carried on it. A center bearing is provided at each end of each container-supporting bridge unit 22 or 24 to connect the bridge unit 22 or 24 to the bodies of the adjacent well units 16, 18 or 20. Each bridge unit retains and supports a container 44 above a structure such as a body bolster at an end of the body of an adjacent container well unit.

As shown in FIGS. 2–9, in the multi-unit car 14 each of the container-carrying bridge units 22 and 24 is a welded structure of steel plates in the form of box-section beams, although other equivalent structural arrangements might be utilized instead. As the bridge units 22 and 24 are similar, the bridge unit 22 will be described herein in detail, together with the adjacent well units 16 and 20, and it will be understood that the bridge unit 24 is of similar construction and is similarly related to the adjacent well units 20 and 18.

The container-supporting bridge unit 22 has a longitudinally extending horizontal center sill 46 equipped at each of its ends 48 and 50 with an upper portion or plate 52 of a center bearing. A lower, or bowl, member 54 of a center bearing is mounted on the top of the body bolster 42 of the adjacent well unit 20, as shown best in FIGS. 2 and 3. At the opposite end 48 of the center sill 46 a similar upper portion or plate 52 rests in an oblong lower, or bowl, member 56 mounted on the top of the body bolster 40 of the other adjacent well unit 16. The center bearing plates 52 are held together with the lower parts or bowls 54 and 56 by locking pins 58 including suitable keys 60 engaged with the shafts of the locking pins 58.

Extending across and welded to the center sill 46 adjacent the opposite ends 48 and 50 of the bridge unit 22 are respective horizontal transverse bolsters 62 and 64.

Suitable side bearings 68 are mounted atop the body bolster 42 of the container well unit 20 on both lateral sides of the center bearing bowl 54 to receive off-center loads from the container-supporting bridge unit 22 through the side bearing support legs 66. Side bearings 70 are similarly mounted atop the body bolster 40 of the well unit 16 on both lateral sides of the oblong center bearing bowl 56. To accommodate the action of the usual draft gear associated with the drawbars 17 and 19, the container-supporting bridge unit 22 is free to move longitudinally a limited distance with respect to the oblong center bearing lower bowl 56, and the respective pin 58 is similarly able to move in the slot 71. To allow such movement of the bridge unit 22 with respect to the body bolster 40 the side bearings 70 on the body bolster 40 are of greater length than the side bearings 68.

The side bearings 68 and 70 may be conventional roller side bearings with a small gap to accommodate normal side-to-side rail height variations yet control lateral rocking of the intermediate unit 22 with respect to the adjacent container well units 16 and 20. Since the body of each container well unit 16, 18 and 20 also has side bearings to limit its movement with respect to each truck 30 or 32, this side bearing arrangement of the container-supporting bridge unit 22 also limits the ability of the bridge unit 22 to roll laterally with respect to the truck 30 or 32 of the adjacent well unit 16 or 20.

Extending horizontally and diagonally outward from each of the transverse bolsters 62 and 64 are pairs of container support arms 72 whose outer ends 74 are separated by the width of a standard cargo container such as the container 44. The container support arms 72, like the transverse bolsters 62 and 64, are shallower than the center sill 46, and are tapered from a greatest width at the transverse bolsters. In view of the particular structure of the well units 16 and 20, the container support arms 72 extend beyond the body bolsters 40 and 42 toward the container wells 38. Thus, the extreme ends 43 and 45 are located above portions of the body end structures 41 of the container well units 16 and 20, between the end of each well 38 and the respective body bolster 40 or 42. This leaves a distance 75, between each end 43 or 45 of the container 44 and the adjacent container well 38, of about 1 to 4 feet, and preferably about 2 feet, depending on the design of the container well units 16 and 20.

Respective twist-lock container-fastening hold-down devices 78 are mounted on the outer ends 74 of the container support arms 72 at locations corresponding with those of the standard placement of container structures defining lifting and stacking apertures to retain and provide direct support for a cargo container 44 carried by the container-supporting bridge unit 22. The previously mentioned locking pins 58 keep the bridge unit 22 attached to the respective container well unit body bolsters 40 and 42 to overcome the hold-down devices 78 when a container 44 is lifted from the bridge unit.

By supporting the container 44 atop the container support arms 72 extending above the body bolsters 40 and 42 of the adjacent well units 20 and 16, the container-supporting bridge unit 22 disclosed herein places the ends 43 and 45 of the container 44 closer longitudinally to a container 34 or 36 or stacked containers carried in the adjacent well units 16 and 20 than is possible in conventional multi-unit container-carrying well cars. The length of the gap 76 between longitudinally adjacent containers may thereby be made as small as about 1 to 4 feet, and preferably about 2 feet, while still leaving adequate room to allow the car 14 to negotiate curved track, and a smaller aerodynamic drag is produced, accordingly, than by containers carried on adjacent container-carrying well car units interconnected with each other by either a drawbar or a shared truck in conventional multi-unit freight cars.

The multi-unit freight car 14 may be constructed as shown with a length 80 of about 229 feet over coupler pulling faces and with a cargo capacity of 593,300 pounds in a load consisting of eight 20-foot containers and three 53-foot containers. This results in a cargo capacity of about 2,590 pounds of cargo for each foot of car length, which is significantly greater than for a previously available freight car with container wells of similar length in drawbar-coupled well units alone.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A multi-unit railroad freight car, comprising:

(a) a plurality of container well units, each including a container well and a body end structure extending longitudinally away from said well, two of said container well units being coupled with each other; and (b) a bridge unit adapted for carrying intermodal cargo containers and extending between said two of said container well units, said bridge unit including a longitudinal sill and at least one transverse bolster fixedly interconnected with said longitudinal sill, said bridge unit being interconnected with said body end structure of each of said container well units.

2. The multi-unit railroad freight car of claim 1, each said body end structure including a body bolster and said car including a plurality of trucks, each of two separate respective ones of said trucks supporting said body bolster of a respective one of two adjacent ones of said container well units, said bridge unit having a pair of opposite ends, and each of said opposite ends of said bridge unit being interconnected with and carried on a respective one of said body bolsters.

3. The multi-unit railroad freight car of claim 1 wherein said longitudinal sill of said bridge unit includes a center sill having a pair of opposite sill ends and a respective center bearing associated with each of said opposite sill ends.

4. The multi-unit freight car of claim 3 wherein one of said center bearings permits a respective one of said sill ends to move longitudinally relative to a respective one of said body end structures.

5. The multi-unit railroad freight car of claim 1, including a drawbar coupling said container well units with each other.

6. The multi-unit railroad freight car of claim 1 wherein said longitudinal sill of said bridge unit includes a center sill having a pair of opposite sill ends and a pair of said transverse bolsters, each of said transverse bolsters being attached to said center sill adjacent a respective one of said opposite sill ends.

7. The multi-unit freight car of claim 6, said bridge unit including a side bearing support leg mounted on one of said transverse bolsters and aligned with a corresponding side bearing located on a respective one of said body end structures.

8. The multi-unit railroad freight car of claim 6 wherein said bridge unit includes a respective pair of container support arms associated structurally with each of said transverse bolsters, each of said container support arms being located above one of said body end structures.

9. The multi-unit railroad freight car of claim 1 wherein said body end structure has a top located higher than a container support in said container well of each said container well unit, and wherein said bridge unit includes a plurality of container support members located higher than said top of said body end structure of each said container well unit.

10. The multi-unit railroad freight car of claim 9 wherein said container support members are located so as to support a container with a portion thereof within a distance of about 1–4 feet from said container well of a respective container well unit.

11. The multi-unit railroad freight car of claim 10 wherein said container support members are located so as to support a container with a portion thereof located a distance of about 2 feet from said container well of a respective container well unit.

12. A multi-unit railroad freight car, comprising:

(a) a plurality of container well units, each including a container well and a pair of body bolsters, two of said container well units being coupled with each other;

(b) a plurality of trucks, each of two separate respective ones of said trucks supporting a respective one of said body bolsters of a respective one of said two container well units; and (c) a bridge unit adapted for carrying intermodal cargo containers and extending between said two of said container well units, said bridge unit including a longitudinal sill and at least one transverse bolster fixedly interconnected with said longitudinal sill, said bridge unit having a pair of opposite ends, and each of said opposite ends of said bridge unit being interconnected with and carried on a respective one of said body bolsters supported by said trucks.

13. The multi-unit railroad freight car of claim 12 wherein said longitudinal sill of said bridge unit includes a center sill having a pair of opposite sill ends and a respective center bearing associated with each of said opposite sill ends.

14. The multi-unit freight car of claim 13 wherein one of said center bearings permits a respective one of said sill ends to move longitudinally relative to a respective one of said body bolsters.

15. The multi-unit railroad freight car of claim 12 wherein said longitudinal sill of said bridge unit includes a center sill having a pair of opposite sill ends and a pair of said transverse bolsters, each of said transverse bolsters being attached to said center sill adjacent a respective one of said opposite sill ends.

16. The multi-unit freight car of claim 15, said bridge unit including a side bearing support leg mounted on one of said transverse bolsters and aligned with a corresponding side bearing foundation located on said respective one of said body bolsters.

17. The multi-unit railroad freight car of claim 15 wherein said bridge unit includes a respective pair of container support arms associated structurally with each of said transverse bolsters, each of said container support arms extending above said respective body bolster toward a respective container well.

18. A container-supporting bridge unit for a multi-unit railroad freight car, comprising:

(a) a longitudinal sill having a pair of opposite sill ends;

(b) a pair of transverse bolsters fixedly interconnected with said longitudinal sill;

(c) a pair of container support arms mounted on and extending outward from each said transverse bolster and beyond a nearer one of said opposite sill ends; and (d) a respective connector adapted to connect each of said sill ends to a respective car body of a respective one of a pair of adjacent coupled units of said multi-unit railroad freight car with each of said sill ends located above the respective car body.

19. The bridge unit of claim 18 wherein said support arms have respective outer ends located with respect to each other in positions corresponding to those of the lifting and stacking receptacles of an intermodal cargo container.

20. The bridge unit of claim 18, including a pair of side bearing supports on each of said transverse bolsters.

21. The bridge unit of claim 18 wherein each said connector includes a center bearing.

22. A bridge unit for supporting a container between container wells defined by car bodies of coupled longitudinally adjacent container well units of a multi-unit railroad freight car, comprising:

a container-supporting structure having a longitudinal structural support member defining a pair of opposite ends thereof, a transverse structural support member interconnected therewith, a container support member interconnected with at least one of said structural support members and extending horizontally away from and longitudinally beyond a nearer one of said opposite ends of said longitudinal structural support member, and bearings adapted for supporting each of said opposite ends of said container supporting structure atop a respective one of said car bodies of said coupled longitudinally adjacent container well units.

* * * * *